US005913312A

United States Patent [19]

Donnell

[11] Patent Number: 5,913,312

[45] Date of Patent: Jun. 22, 1999

[54] NAIL POLISH BOTTLE HOLDER

[76] Inventor: Karla R. Donnell, 5707 Ponderosa, Colleyville, Tex. 76034

[21] Appl. No.: 09/081,732

[22] Filed: May 20, 1998

[51] Int. Cl.[6] ..... A45D 29/00; A45D 29/18; A47B 73/00

[52] U.S. Cl. ..... 132/73; 132/73.5; 211/74

[58] Field of Search ..... 132/73, 73.5; 248/346.01, 248/346.02, 346.03; 215/393, 394, 395; 211/74

[56] References Cited

U.S. PATENT DOCUMENTS

| | | | |
|---|---|---|---|
| 1,759,390 | 5/1930 | Brandt . | |
| 2,197,326 | 4/1940 | Streyle | 211/74 |
| 2,748,952 | 6/1956 | Fleit et al. | 211/74 |
| 3,819,039 | 6/1974 | Erickson | 206/388 |
| 4,050,584 | 9/1977 | Lino | 211/76 |
| 4,296,766 | 10/1981 | Benis | 132/73 |
| 5,685,438 | 11/1997 | Emanuel et al. | 211/70.1 |
| 5,743,500 | 4/1998 | Northway et al. | 248/146 |

*Primary Examiner*—John J. Wilson
*Assistant Examiner*—Trang Doan
*Attorney, Agent, or Firm*—Charles D. Gunter, Jr.

[57] ABSTRACT

A portable cosmetic bottle holder is formed from a sheet of flexible foam material having a thickness and having a generally U-shaped configuration that is defined by a periphery. The foam is provided with a plurality of recepticles for receiving and holding cosmetic bottles. The foam material has an interior spaced inward from the periphery that defines a work space where one can rest their hands when applying cosmetics, such as nail polish. A rigid backing layer may be joined to the lower surface of the foam.

11 Claims, 1 Drawing Sheet

NAIL POLISH BOTTLE HOLDER

BACKGROUND OF THE INVENTION

1. Field of the Invention:

This invention relates in general to devices used for holding or storing bottles or containers, and in particular to devices used for holding cosmetic bottles or containers.

2. Description of the Prior Art:

Users of cosmetics often have a number of bottles or containers containing different cosmetics. These are often stored or gathered together and placed in a drawer, cabinet or other storage area in a haphazard fashion, so that locating and retrieving a particular cosmetic may become a frustrating event.

Further, when in use, some cosmetics bottles, such as those used for storing nail polish, are often placed on a counter top or support surface while the container or bottle remains open. For instance, nail polish bottles are usually supplied with a lid or cap that carries a brush or applicator. As a result, the bottle remains open while the brush is being used to apply the nail polish. If the bottle is accidentally knocked over, the nail polish will spill out, resulting in a mess that is quite often difficult to clean. Because it may be necessary to redip the brush or applicator into the bottle of nail polish, the insertion and removal of the applicator itself often causes the bottle to be knocked over. Consequently, such spills are not infrequent.

What is therefore needed is a device for holding cosmetic bottles or containers in an organized fashion and that prevents the bottles or containers from spilling during use.

SUMMARY OF THE INVENTION

A cosmetic bottle holder is provided in the form of a sheet of flexible foam material having a thickness and being defined by a periphery. An interior of the sheet is spaced inward from the periphery. The flexible foam has an upper surface and a lower surface. At least one recepticle is formed in the upper surface of the foam along the periphery that extends through at least a portion of the foam's thickness for receiving a cosmetic bottle. The upper surface of the interior of the foam sheet forms a work area for resting one's hands while the cosmetic bottle is held within the recepticle. The foam sheet is portable so that the foam sheet may be selectively positioned upon a support surface.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
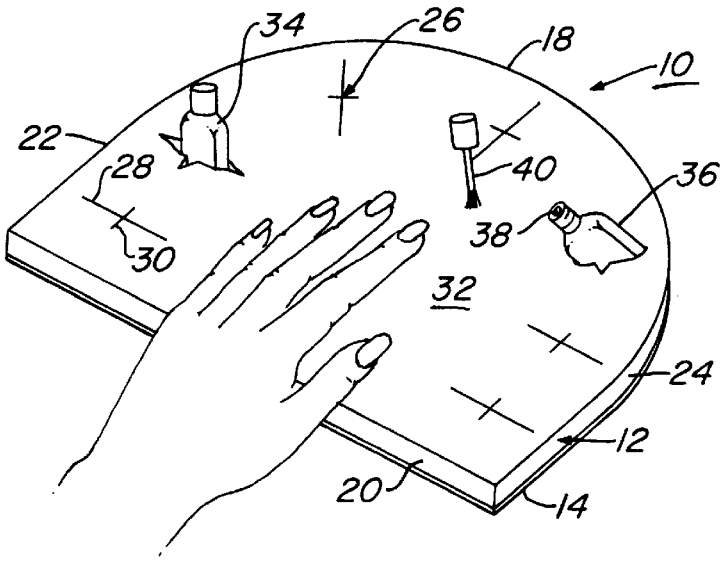
FIG. 1 is a perspective view of a cosmetic bottle holder constructed in accordance with the invention.
Figure 2:
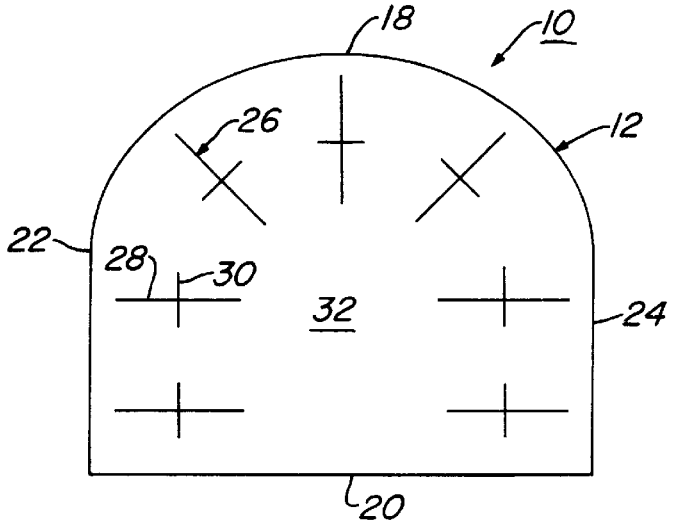
FIG. 2 is a top elevational view of the cosmetic bottle holder.
Figure 3:
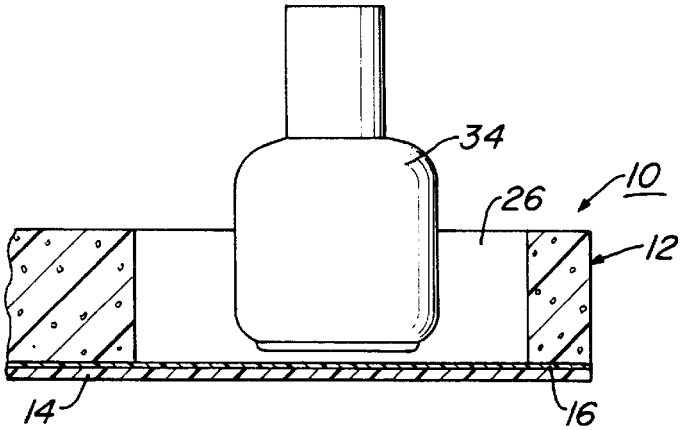
FIG. 3 is a cross-sectional view of the cosmetic bottle holder, showing a cosmetic bottle within a slit of the bottle holder.

Referring to the FIGS. 1–3, a cosmetic bottle holder 10 is shown. The holder 10 is formed from a flexible sheet 12 of foam material, such as open-cell foam or sponge rubber. The foam 12 may be between about one-half to four inches in thickness, with one to two inches in thickness being preferable.

Joined to the lower surface of the foam 12 is a layer of backing material 14. The backing material 14 covers generally the entire lower surface of the foam 12 and is bonded thereto by a layer of adhesive 16. The backing material 14 should be a thin rigid layer of material to provide support and stiffness to the holder 10. Suitable materials for the backing layer 14 include plastic or cardboard, but may be other materials as well. Preferably, the backing material 14 is between about 1/16 to 1/4 inch in thickness.

As seen in FIG. 2, the holder 10 has a generally U-shaped configuration, with the forward edge 18 being curved and the opposite rearward edge 20 being a flat or straight edge. The holder 10 may have various configurations and dimensions, but suitable dimensions have been found to be between about six to twenty inches in length, as measured from the forward edge 18 to the rearward edge 20, and between about six to twenty inches in width, as measured between side edges 22, 24. Preferably, the holder 10 has dimensions of between ten to twenty inches in length and width.

Formed in the upper surface of the foam 12 and extending through the thickness of the foam 12 are a plurality of spaced apart bottle recepticles 26. Between about 5 to 15 recepticles has been found to be a suitable number. The recepticles 26 are formed from crosscut slits 28, 30. Each slit 28 is generally perpendicular to its adjacent edge of the foam 12 and has a length of between about two to four inches. Each slit 30 is generally parallel to its adjacent edge of the foam 12 and has a length of between about one to two inches. The slits 28, 30 are cut into the foam's thickness a sufficient depth to ensure that bottles inserted into the recepticles are securely held in place.

The recepticles 26 are positioned around the periphery of the foam 12, adjacent to the side edges 22, 24 and curved forward edge 18. The area adjacent to the rearward edge 20 is generally free of recepticles so that a work space 32 is defined on the upper surface of the foam 12 that extends from the rearward edge 20 to an interior portion of the foam 12 defined by the recepticles 26.

In use, cosmetic bottles, such as the nail polish bottle 34 are positioned within the recepticles 26 as desired. The foam material along the side edges of the slits 28, 30 will deform so that it is compressed around the bottle 34, thus holding the bottle securely in place within the foam layer 12. If necessary, the bottle may be articulated or tilted at an angle, as is shown at 36 in FIG. 1, so that the opening 38 of the bottle 36 faces toward the user, making it easier to access the opening 38.

The user may rest their hands on the work space 32 while applying the nail polish. The work space 32 also protects the underlying support surface from spills and drips, such as from the applicator 40.

The cosmetic bottle holder has several advantages. The bottle holder is portable and may be moved easily from place to place. Several bottles may be held and arranged in an organized fashion so that they are not lost or misplaced. The bottles may be articulated within the recepticles to facilitate access to the bottle when applying the cosmetic contents. There is no danger of knocking the bottles over, as often occurs when the bottles are merely placed upon a support surface by themselves, as the bottles are securely held in place within the recepticles. The bottle holder has a convenient work space where one may rest their hands when applying the cosmetic. The underlying support surface is also protected by the bottle holder from spills or drips.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. A cosmetic bottle holder comprising:

sheet of flexible foam material having a thickness and being defined by a periphery and having an interior spaced inward from the periphery, the flexible foam having an upper surface and a lower surface, at least one recepticle formed from slits sized to be fitted to hold a nail polish bottle therein, the receptacle being formed in the upper surface of the foam along the curved portion of the periphery that extends through at least a portion of the foam's thickness for receiving a nail polish bottle, and wherein the upper surface of the interior of the foam sheet forms a work area for resting one's hands while the nail polish bottle in hold within the recepticle, the foam sheet being portable so that the foam sheet may be selectively positioned upon a support surface.

2. The cosmetic bottle holder of claim 1, wherein:

the recepticle is formed from a slit cut into the foam.

3. The cosmetic bottle holder of claim 1, further comprising:

a rigid layer of backing material joined to the lower surface of the foam, the backing material covering generally the entire lower surface of the foam sheet.

4. The cosmetic bottle holder of claim 1, wherein:

the thickness of the foam is between about ½ to 4 inches.

5. The cosmetic bottle holder of claim 2, wherein:

there are a plurality of slits formed along the periphery that are spaced apart from each other, each slit forming a recepticle for receiving cosmetic bottles.

6. The cosmetic bottle holder of claim 1, wherein:

the receptical is formed from a pair of cross-cut slits.

7. The cosmetic bottle holder of claim 1, wherein:

the foam sheet has a generally U-shaped configuration so that one portion of the periphery is curved and the portion of the periphery opposite the curved portion is generally straight, the at least one slit being formed along the curved portion of the periphery.

8. A portable cosmetic bottle holder comprising:

a sheet of flexible foam material having a thickness and having a generally U-shaped configuration being defined by a periphery so that one portion of the periphery is curved and the portion of the periphery opposite the curved portion is generally straight, the foam material having an interior spaced inward from the periphery, the flexible foam having an upper surface and a lower surface, a plurality of recepticles formed from slits sized to be fitted to hold a nail polish bottle therein in the upper surface of the foam along the curved portion of the periphery that extend through at least a portion of the foam's thickness for receiving a nail polish bottle, and wherein the upper surface of the interior of the foam sheet forms a work area for resting one's hands while the nail polish bottle is held within the recepticle; and a rigid layer of backing material joined to the lower surface of the foam, the backing material covering generally the entire lower surface of the foam sheet.

9. The cosmetic bottle holder of claim 8, wherein:

the thickness of the foam is between about ½ to 4 inches.

10. The cosmetic bottle holder of claim 8, wherein:

the thickness of the foam is between about 1 to 2 inches.

11. The cosmetic bottle holder of claim 8, wherein:

the receptacle is formed from a pair of cross-cut slits.

* * * * *